US007884794B2

(12) United States Patent
Okutani

(10) Patent No.: US 7,884,794 B2
(45) Date of Patent: Feb. 8, 2011

(54) SMALL-SIZED DATA LINE DRIVER CAPABLE OF GENERATING DEFINITE NON-VIDEO GRADATION VOLTAGE

(75) Inventor: Shigeki Okutani, Shiga (JP)

(73) Assignee: Renesas Electronics Corporation, Kanagawa (JP)

( * ) Notice: Subject to any disclaimer, the term of this patent is extended or adjusted under 35 U.S.C. 154(b) by 1295 days.

(21) Appl. No.: 11/168,472

(22) Filed: Jun. 29, 2005

(65) Prior Publication Data

US 2006/0001636 A1 Jan. 5, 2006

(30) Foreign Application Priority Data

Jun. 30, 2004 (JP) ..... 2004-192811

(51) Int. Cl.
*G09G 3/36* (2006.01)

(52) U.S. Cl. ..... 345/100

(58) Field of Classification Search ..... 345/76–104, 345/204; 377/64–81
See application file for complete search history.

(56) References Cited

U.S. PATENT DOCUMENTS

2003/0090451 A1* 5/2003 Ahn ..... 345/96

FOREIGN PATENT DOCUMENTS

JP 2001-060078 3/2001

* cited by examiner

*Primary Examiner*—Sumati Lefkowitz
*Assistant Examiner*—Robert E Carter, III
(74) *Attorney, Agent, or Firm*—Foley & Lardner LLP

(57) ABSTRACT

In a data line driver for driving data lines of a display apparatus, a data register is adapted to latch video data and a definite non-video gradation data via a data bus. A data latch circuit is adapted to latch the video data and the definite non-video gradation data at different timings to generate digital output signals. A digital/analog converter is adapted to convert the digital output signals of the data latch circuit into analog signals. An output buffer is adapted to apply the analog signals of the digital/analog converter to the data lines.

9 Claims, 13 Drawing Sheets

4'
CONTROLLER
XX
R
G
B
HSYNC
VSYNC
HST
HCK
AST
DA/XX
AEN
STB
DB
VST
VCK
2'-1
2'-2
2'-10
HST1
HST2
HST9
384
384
384
1
LCD PANEL
(1280×3×1024 DOTS)
DL
SL
Q
C
3-1
3-2
3-3
3-4
256
256
256
256
VST1
VST2
VST3

SMALL-SIZED DATA LINE DRIVER CAPABLE OF GENERATING DEFINITE NON-VIDEO GRADATION VOLTAGE

BACKGROUND OF THE INVENTION

1. Field of the Invention

The present invention relates to a data line driver of a plane type display apparatus such as a liquid crystal display (LCD) apparatus.

2. Description of the Related Art

In a plane type display apparatus including a panel having data lines (or signal lines), scan lines (or gate lines) and cells each located at one intersection between the data lines and the scan lines, a data line driver is provided for driving the data lines, and a scan line driver is provided for driving the scan lines.

In order to improve the quality of a moving image, i.e., in order to remove the effect of a residual image of a moving image, the data line driver switches a gradation voltage with a black voltage (see: JP-2001-60078-A). For example, the data line driver includes a switch circuit for applying a black voltage instead of the output signals of an output buffer to data lines (see: FIG. 2 of JP-2001-60078-A) or a switch circuit for generating black data instead of the output signal of a data register (see: FIG. 3 of JP-2001-60078-A). This will be explained later in detail.

In the above-described prior art data line driver, however, since the black voltage or the black data is usually fixed, it is impossible to apply a definite non-video gradation voltage to the data lines. Note that such a definite non-video gradation voltage may be requested by customers, i.e., display apparatus manufacturers. In this case, if the black voltage or black data is generated from a variable power supply voltage generating circuit or a plurality of definite non-video gradation voltage generating circuits, the size of the data line driver is further increased.

SUMMARY OF THE INVENTION

It is an object of the present invention to provide a small-sized data line driver for a plane type display apparatus capable of applying a definite non-video gradation voltage to data lines.

According to the present invention, in a data line driver for driving data lines of a display apparatus, a data register is adapted to latch video data and a definite non-video gradation data via a data bus. A data latch circuit is adapted to latch the video data and the definite non-video gradation data at different timings to generate digital output signals. A digital/analog converter is adapted to convert the digital output signals of the data latch circuit into analog signals. An output buffer is adapted to apply the analog signals of the digital/analog converter to the data lines.

BRIEF DESCRIPTION OF THE DRAWINGS

The present invention will be more clearly understood from the description set forth below, as compared with the prior art, with reference to the accompanying drawings, wherein.

DESCRIPTION OF THE PREFERRED EMBODIMENT

Before the description of the preferred embodiment, a prior art LCD apparatus will be explained with reference to FIGS. 1, 2, 3A, 3B and 4.

Figure 1:
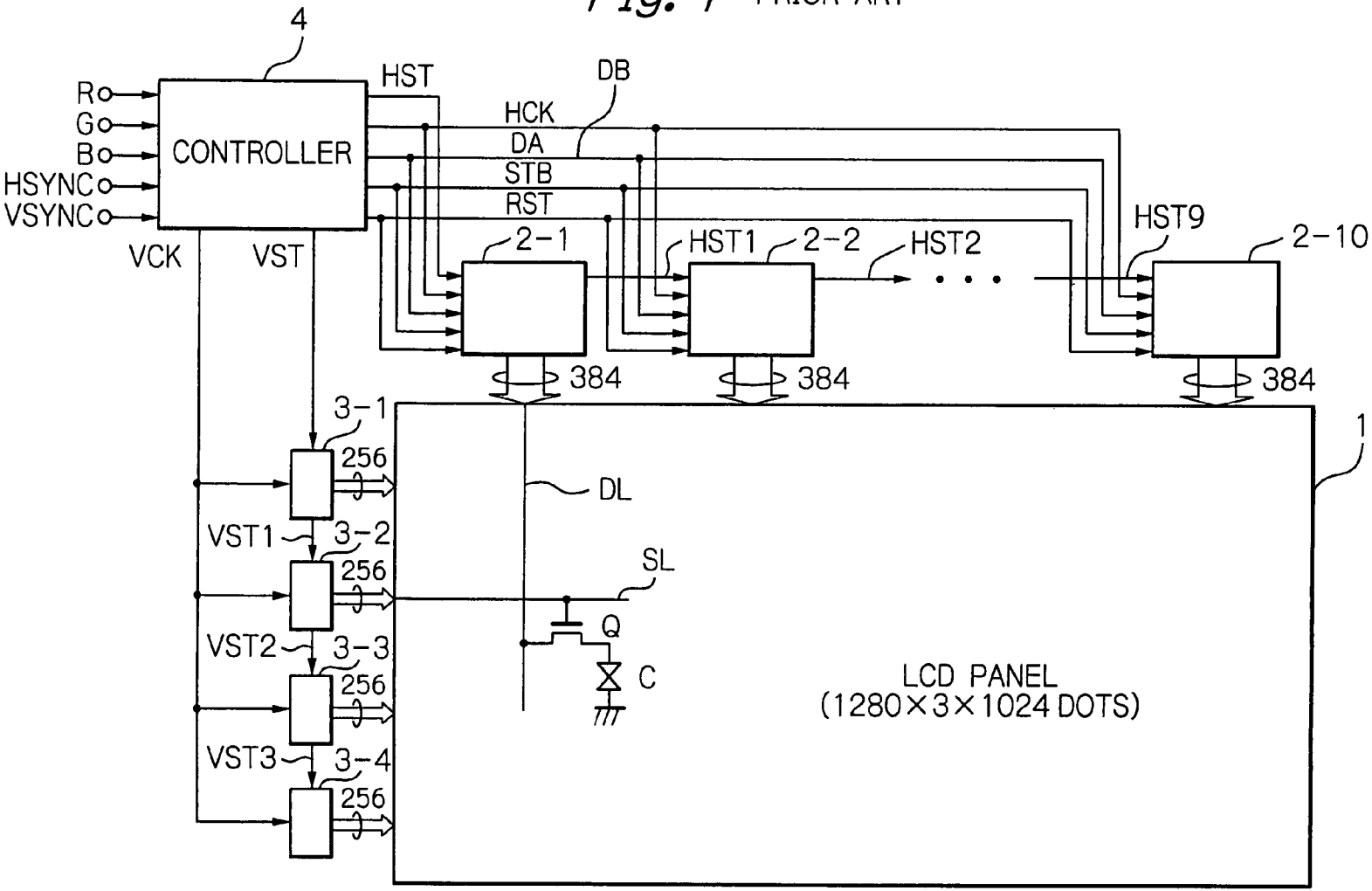
Fig. 1 PRIOR ART
FIG. 1 is a block circuit diagram illustrating a prior art LCD apparatus.

In FIG. 1, which illustrates a prior art LCD apparatus, reference numeral 1 designates an LCD panel having 1280×1024 pixels each formed by three color dots, i.e., R (red), G (green) and B (blue). Therefore, the LCD panel 1 includes 3932160 dots located at 3840 (=1028×3) data lines (or signal lines) DL and 1024 scan lines (or gate lines) SL. One dot is formed by one thin film transistor Q and one liquid crystal cell C. For example, if one dot is represented by 64 gradation voltages, one pixel is represented by 262144 (=64×64×64) colors. This LCD panel is called a super extended graphics array (SXGA).

In order to drive the 3840 data lines DL, ten data line drivers 2-1, 2-2, . . . , 2-10 each for driving 384 data lines are provided along a horizontal edge of the LCD panel 1. On the other hand, in order to drive the 1024 scan lines SL, four scan line drivers 3-1, 3-2, 3-3 and 3-4 each for driving 256 scan lines are provided along a vertical edge of the LCD panel 1.

A controller 4 receives color signals R, G and B, a horizontal synchronization signal HSYNC and a vertical synchronization signal VSYNC from a personal computer or the like using a low voltage differential signaling (LVDS) interface, and generates a horizontal start signal HST, a horizontal clock signal HCK, a video signal DA via a data bus DB, a strobe signal STB for the data line drivers 2-1, 2-2, . . . , 2-10, a reset signal RST for supplying a black voltage BV to the data lines DL, a vertical start signal VST and a vertical clock signal VCK for the scan line drivers 3-1, 3-2, 3-3 and 3-4.

In FIG. 1, the data line drivers 2-1, 2-2, . . . , 2-10 are arranged by a cascade connection method to pass the horizontal start signal HST therethrough in synchronization with the horizontal clock signal HCK. In this case, if a horizontal start signal output from the data line driver 2-1 is denoted by HST1, the horizontal start signal HST1 is supplied to the data line driver 2-2. Also, if a horizontal start signal output from the data line driver 2-2 is denoted by HST2, the horizontal start signal HST2 is supplied to the data line driver 2-3. Further, if a horizontal start signal output from the data line driver 2-9 is denoted by HST9, the horizontal start signal HST9 is supplied to the data line driver 2-10.

Also, in FIG. 1, the scan line drivers 3-1, 3-2, 3-3 and 3-4 are arranged by a cascade connection method to pass the vertical start signal VST therethrough in synchronization with the vertical clock signal VCK. In this case, if a vertical start signal output from the scan line driver 3-1 is denoted by VST1, the vertical start signal VST1 is supplied to the scan line driver 3-2. Also, if a vertical start signal output from the scan line driver 3-2 is denoted by VST2, the vertical start signal VST2 is supplied to the scan line driver 3-3. Further, if a vertical start signal output from the scan line driver 3-3 is denoted by VST3, the vertical start signal VST3 is supplied to the scan line driver 3-4.

The operation of the LCD apparatus of FIG. 1 will now be briefly explained. A vertical start signal VST is shifted within the shift registers of each of the scan line drivers 3-1, 3-2, 3-3 and 3-4, so that one scan line is selected to turn ON all the thin film transistors Q connected thereto. On the other hand, a horizontal start signal HST is shifted within the shift registers of each of the data line drivers 2-1, 2-2, . . . , 2-10, so that video data of one scan line is latched. Then, the gradation voltages corresponding to the video data are applied by the strobe signal STB via the thin film transistors at the scan line to the liquid crystal cells C thereof. After that, the gradation voltages applied to the liquid crystal cells C are maintained until the next selecting operation is performed thereon.

Figure 2:
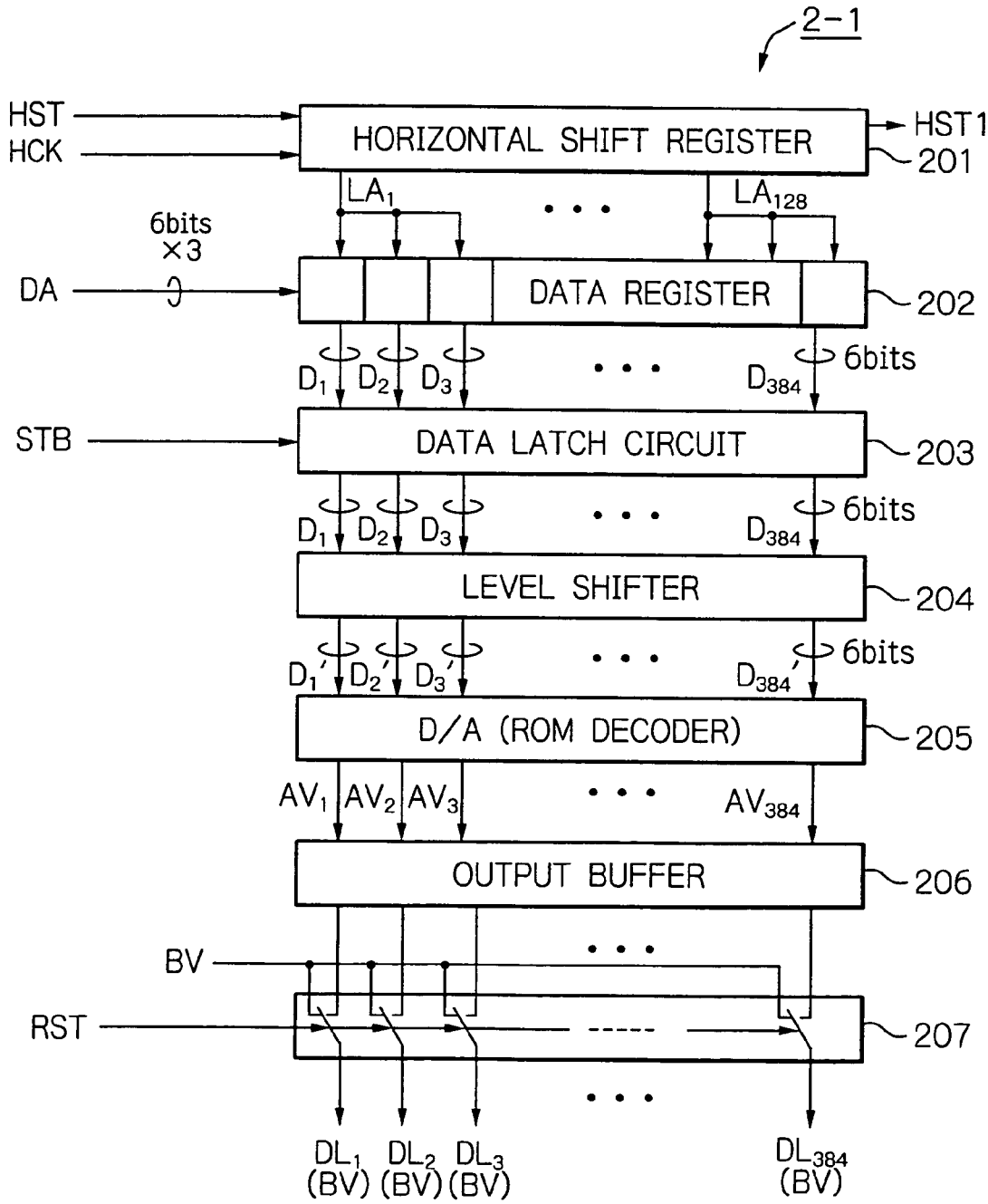
Fig. 2 PRIOR ART
FIG. 2 is a detailed block circuit diagram of the data line driver of FIG. 1.

In FIG. 2, which is a detailed block circuit diagram of the data line driver 2-1 of FIG. 1, the data line driver 2-1 is constructed by a horizontal shift register 201, a data register 202, a data latch circuit 203, a level shifter 204, a digital/analog (D/A) converter 205, an output buffer 206 formed by voltage followers, and a switch circuit 207 for applying the output signal of the output buffer 207 or the black voltage BV to data lines $DL_1$, $DL_2$, $DL_3$, . . . , $DL_{384}$ (see: FIG. 2 of JP-2001-60078-A).

The horizontal shift register 201 shifts the horizontal start signal HST in synchronization with the horizontal clock signal HCK, to sequentially generate latch signals $LA_1$, . . . , $LA_{128}$. The horizontal shift register 201 also generates the horizontal start signal HST1 for the next stage data line driver 2-2.

The data register 202 latches the video signal DA(18 bits) formed by red data (R)(6 bits), green data (G)(6 bits) and blue data (B)(6 bits) in synchronization with the latch signals $LA_1$, . . . , $LA_{128}$, to generate video data $D_1$, $D_2$, $D_3$, . . . , $D_{384}$, respectively. This will be explained later in detail. The video data $D_1$, $D_2$, $D_3$, . . . , $D_{384}$ are supplied to the data latch circuit 203.

The data latch circuit 203 latches the video data $D_1$, $D_2$, $D_3$, . . . , $D_{384}$ of the data register 202 in synchronization with the strobe signal STB.

The level shifter 204 shifts the video data $D_1$, $D_2$, $D_3$, . . . , $D_{384}$ by a level shift amount ΔV applied to the liquid crystal of the LCD panel 1 to generate video data $D_1'$, $D_2'$, $D_3'$, . . . , $D_{384}'$. That is, the level shift amount ΔV is a preset voltage to initiate the change of the transmittance of the liquid crystal.

The D/A converter 205 performs D/A conversions upon the shifted video data $D_1'$, $D_2'$, $D_3'$, . . . , $D_{384}'$, using the multi-gradation voltages such as 64 gradation voltages to generate analog voltages $AV_1$, $AV_2$, $AV_3$, . . . , $AV_{384}$ which are applied via the output buffer 206 to the switch circuit 207.

When the reset signal RST is high (="1"), the switch circuit 207 applies the analog voltages $AV_1$, $AV_2$, $AV_3$, . . . , $AV_{384}$ to the data lines $DL_1$, $DL_2$, $DL_3$, . . . , $DL_{384}$, respectively. On the other hand, when the reset signal RST is low (="0"), the switch circuit 207 applies the black voltage BV to the data lines $DL_1$, $DL_2$, $DL_3$, . . . , $DL_{384}$.

Figure 3A:
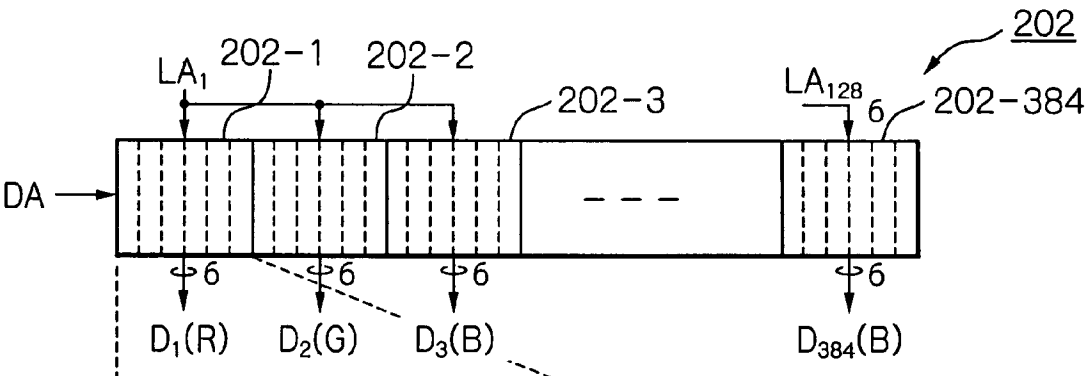
Fig. 3A PRIOR ART
FIG. 3A is a detailed block circuit diagram of the data register of FIG. 2.
Figure 3B:
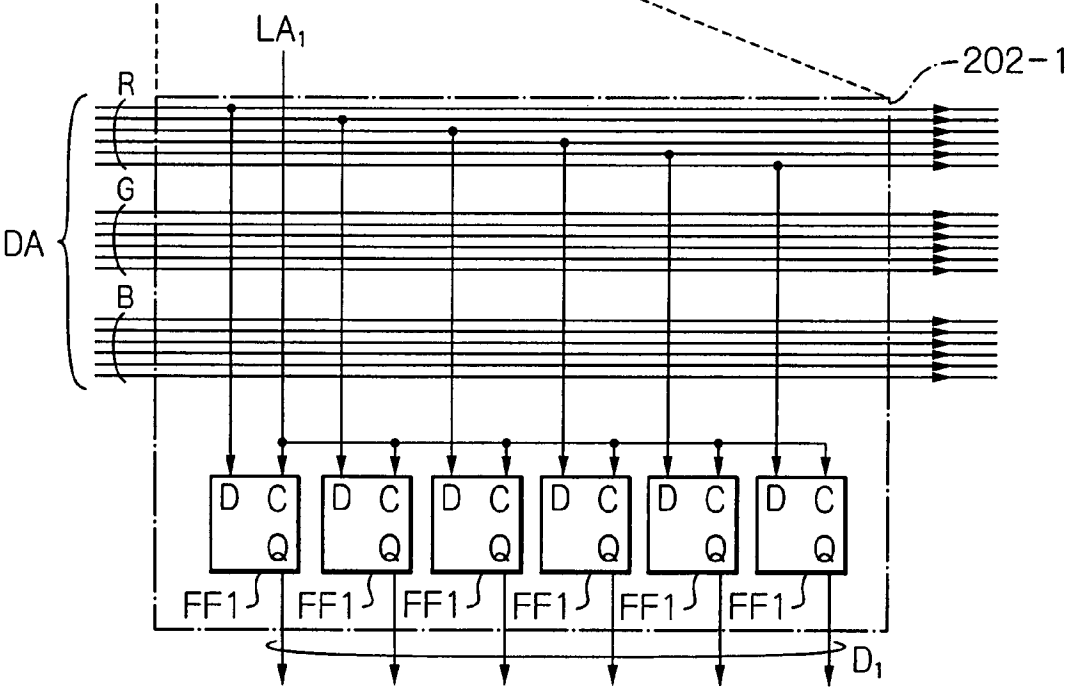
Fig. 3B PRIOR ART
FIG. 3B is a detailed block circuit diagram of the 6-bit data register of FIG. 3A.

The data register 202 is constructed by 384 6-bit data registers 202-1, 202-2, 202-3, . . . , 202-384 as illustrated in FIG. 3A, and each of the 6-bit data registers 202-1, 202-2, 202-3, . . . , 202-384 is constructed by six D-type flip-flops FF1 as illustrated in FIG. 3B. For example, the 6-bit data register 202-1 latches the video data $D_1$ in synchronization with a rising edge of the latch signal $LA_1$.

In FIG. 2, however, since the black voltage BV is usually fixed, it is impossible to apply a definite non-video gradation voltage to the data lines $DL_1$, $DL_2$, $DL_3$, . . . , $DL_{384}$. If the black voltage BV is generated from a variable power supply voltage generating circuit which would be controlled by the controller 4 of FIG. 1, such a definite non-video gradation voltage can be generated from the variable power supply voltage generating circuit. In this case, however, since the variable power supply voltage generating circuit may be large in size, the size of the data line drivers 2-1, 2-2, . . . , 2-10 is increased.

Figure 4:
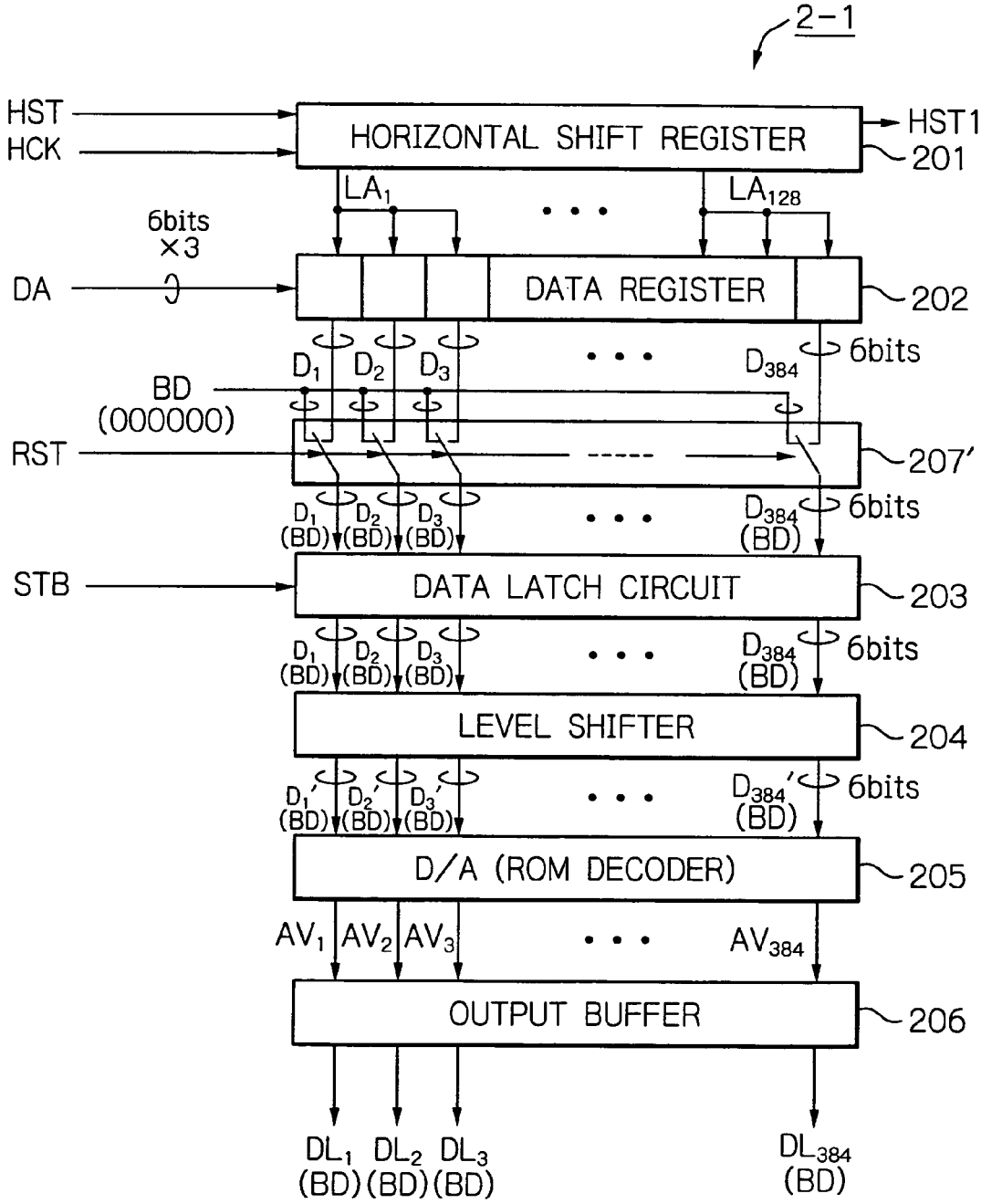
Fig. 4 PRIOR ART
FIG. 4 is a block circuit diagram of a modification of the data line driver of FIG. 2.

In FIG. 4, which illustrates a modification of the data line driver of FIG. 2, instead of the switch circuit 207 of FIG. 2, a switch circuit 207' similar to the switch circuit 207 of FIG. 2 is provided between the data register 202 and the data latch circuit 203 of FIG. 2 (see: FIG. 3 of JP-2001-60078-A).

The switch circuit 207' applies the output signal of the data register 202 or black data BD (=000000) corresponding to the black voltage BV of FIG. 2 to the data latch circuit 203. That is, when the reset signal RST is high (="1"), the switch circuit 207' applies the output signal of the data register 202 to the data latch circuit 203. On the other hand, when the reset signal RST is low (="0"), the switch circuit 207' applies the black data BD to the data latch circuit 203.

In FIG. 4, however, since the black data BD is usually fixed, it is impossible to apply a definite non-video gradation voltage to the data lines $DL_1$, $DL_2$, $DL_3$, . . . , $DL_{384}$. If the black data BD is generated from a plurality of definite non-video gradation voltage generating circuits which would be controlled by the controller 4 of FIG. 1, such a definite non-video gradation voltage can be generated by selecting one of the definite non-video gradation voltage generating circuits. In this case, however, the connections between the definite non-video gradation generating circuits and the switch circuit 207' are so complicated that the size of the data line drivers 2-1, 2-2, . . . , 2-10 is increased.

Figure 5:
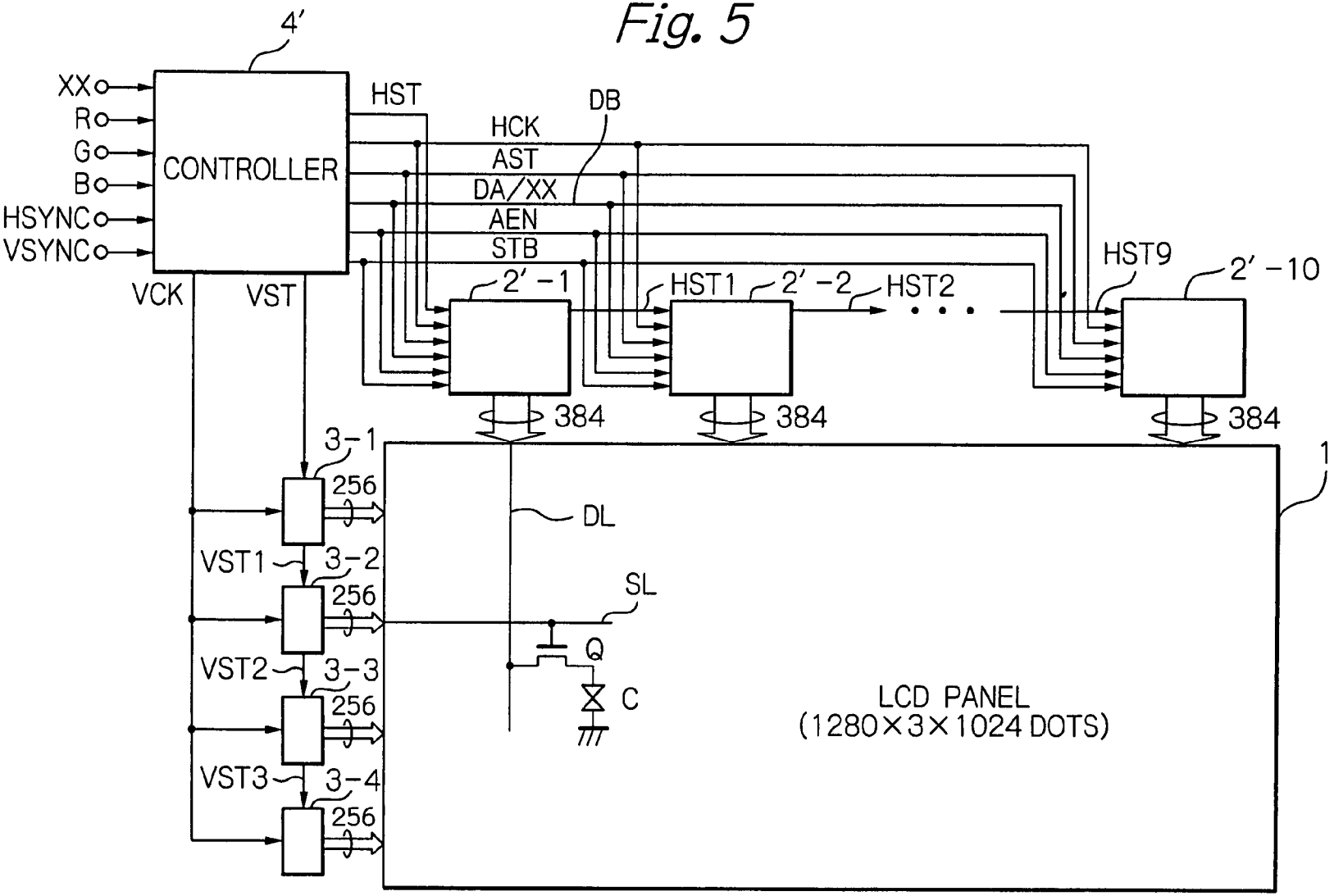
FIG. 5 is a block circuit diagram illustrating an embodiment of the LCD apparatus according to the present invention.

In FIG. 5, which illustrates an embodiment of the LCD apparatus according to the present invention, the data line drivers 2-1, 2-2, . . . , 2-10 and the controller 4 of FIG. 1 are replaced by data line drivers 2'-1, 2'-2, . . . , 2'-10 and a controller 4', respectively. Note that a definite non-video gradation data XX is set in a memory (not shown) of the controller 4' in advance by customers, i.e., display apparatus manufacturers.

The controller 4' generates the definite non-video gradation data XX time-divisionally with the video signal DA via a data bus DB. Also, the controller 4' generates a definite non-video gradation data start signal AST and a definite non-video data enable signal AEN instead of the reset signal RST of the controller 4 of FIG. 1.

Figure 6:
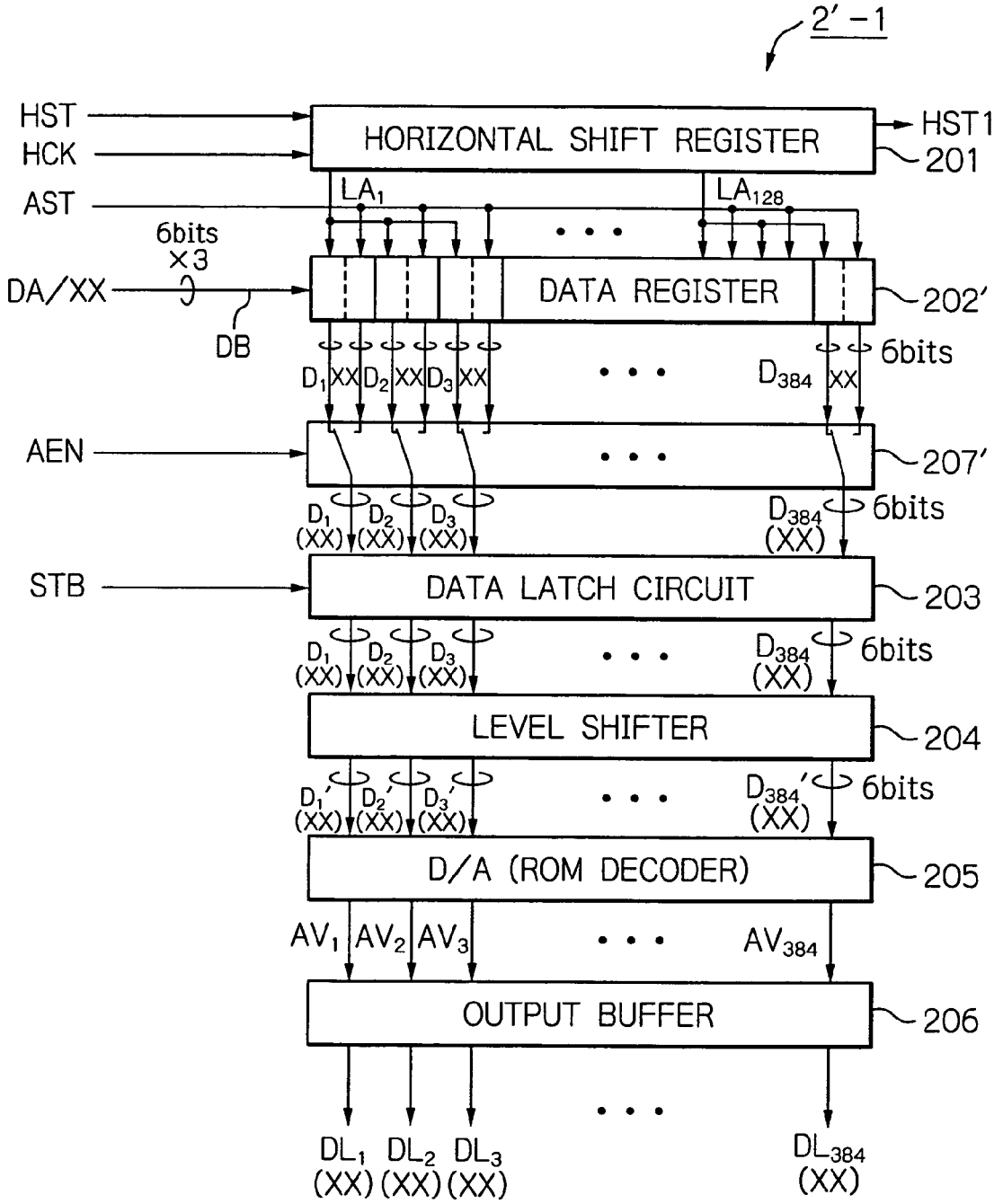
FIG. 6 is a detailed block circuit diagram of a first example of the data line driver of FIG. 5.

In FIG. 6, which is a detailed block circuit diagram of a first example of the data line driver 2'-1 of FIG. 5, the data register 202 of FIG. 4 is replaced by a data register 202' which can also latch the definite non-video gradation data XX as well as the video signal DA. Also, the switch circuit 207' similar to the switch circuit 207 of FIG. 4 selects the video data $D_1$, $D_2$, $D_3, \ldots, D_{384}$ or the definite non-video gradation data XX in accordance with the definite non-video gradation data enable signal AEN.

Figures 7A, 7B:
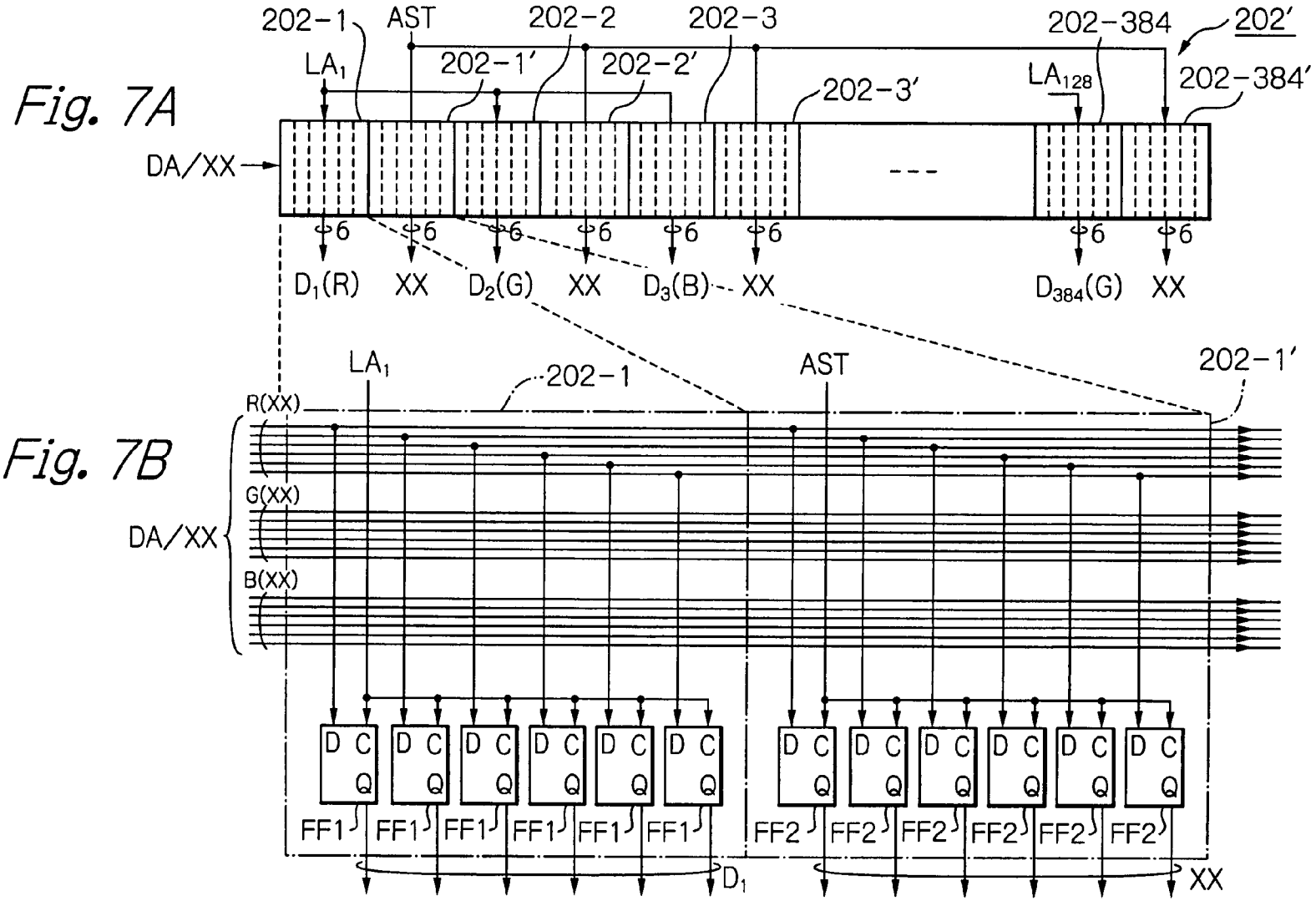
FIG. 7A is a detailed block circuit diagram of the data register of FIG. 6.
FIG. 7B is a detailed block circuit diagram of the 6-bit data register of FIG. 7A.

As illustrated in FIG. 7A, the data register 202' includes 384 6-bit data registers 202-1', 202-2', 202-3', . . . , 202-384' in addition to the 384 6-bit data registers 202-1, 202-2, 202-3, . . . , 202-384 of FIG. 3A. Also, as illustrated in FIG. 7B, each of the 6-bit data registers 202-1', 202-2', 202-3', . . . , 202-384' is constructed by six D-type flip-flops FF2. For example, the 6-bit data register 202-1' latches the definite non-video gradation data XX in synchronization with a rising edge of the definite non-video gradation data start signal AST.

A first operation of the data line driver of FIG. 6 is explained next with reference to FIG. 8 which shows an operation for one data line such as $DL_1$.

First, at time t0, a definite non-video gradation data start signal AST is generated, so that the definite non-video gradation data XX is latched in the 6-bit data register 202-1' (the flip-flops FF2) of the data register 202'.

Next, at time t1, a horizontal start signal HST is generated, so that the horizontal shift register 201 generates a latch signal LA, in synchronization with a horizontal clock signal HCK. As a result, a video data $D_1$ is latched as an effective data (1) in the 6-bit data register 202-1 (the flip-flops FF1) of the data register 202' and is supplied to the switch circuit 207' for the data line $DL_1$.

Next, at time t2, a definite non-video gradation data enable signal AEN is changed from high to low, and at time t3, a strobe signal STB is generated. As a result, the definite non-video gradation data XX is supplied via the level shifter 204 and the D/A converter 205 to the output buffer 206. Thus, a definite non-video gradation voltage corresponding to the definite non-video gradation data XX is applied to the data line $DL_1$. Then, at time t4, the definite non-video gradation data enable signal AEN is changed from low to high, so that the definite non-video gradation data XX remains in the 6-bit data register 202-1' of the data register 202' for the data line $DL_1$. Thus, the definite non-video gradation voltage at the data line $DL_1$ is retained.

Finally, at time t5, when a strobe signal STB is generated while the definite non-video gradation voltage enable signal AEN remains high, the effective data (1) of the 6-bit data register 202-1 (the flip-flops FF1) of the data register 202' is latched in the data latch circuit 203, so that the effective data (1) of the video data $D_1$ is supplied via the level shifter 204 and the D/A converter 205 to the output buffer 206. As a result, a gradation voltage corresponding to the effective data (1) of the video data $D_1$ is applied to the data line $DL_1$.

Figure 8:
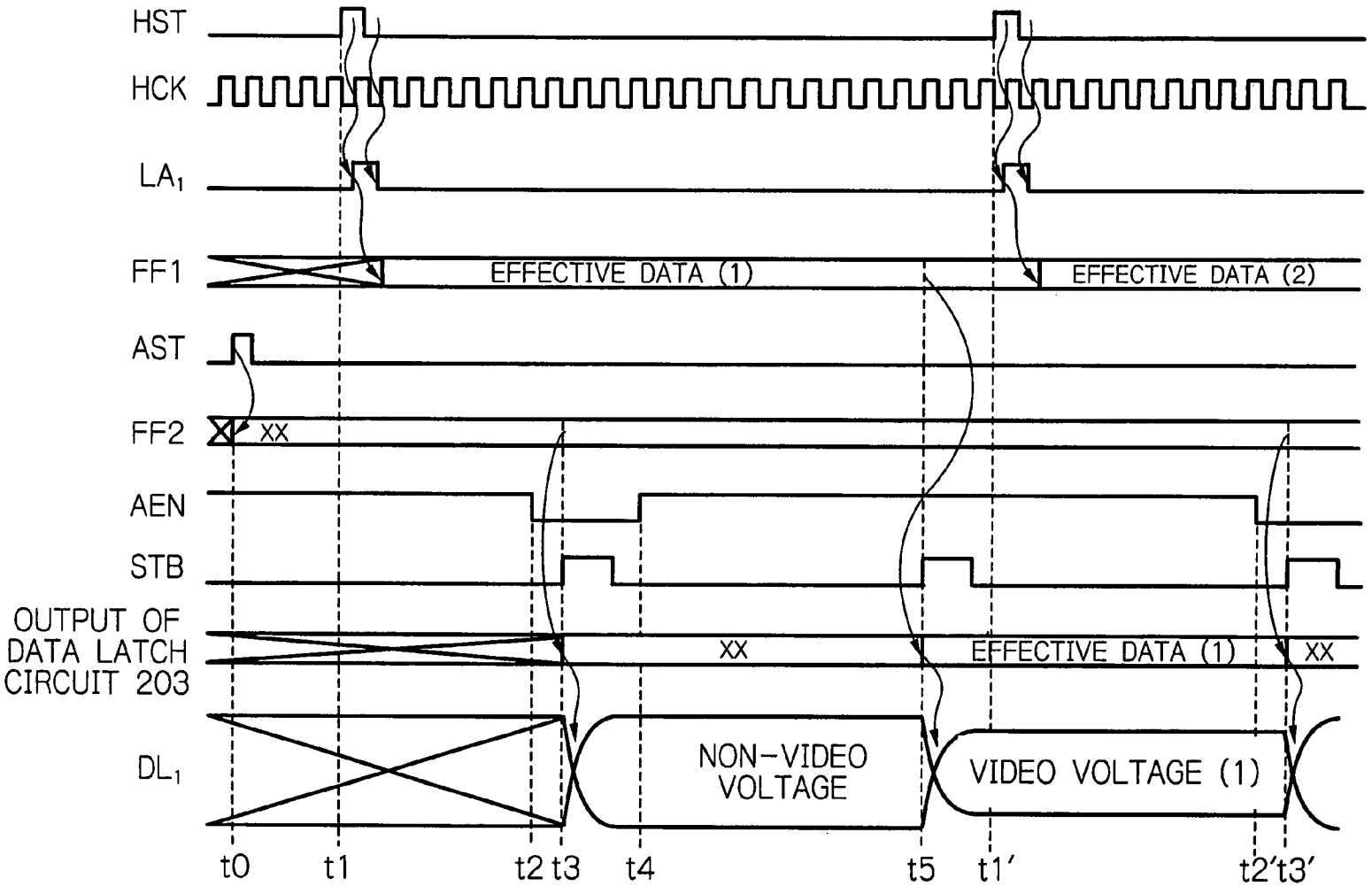
FIGS. 8 and 9 are timing diagrams for explaining the operation of the data register of FIG. 7A.

Thus, in FIG. 8, a gradation voltage and a definite non-video gradation voltage are alternately switched. In this case, the polarity of the gradation voltage is opposite to that of the definite non-video gradation voltage during one strobe signal period, thus removing the residual image effect of a moving image, particularly when the definite non-video gradation voltage represents a black voltage.

Figure 9:
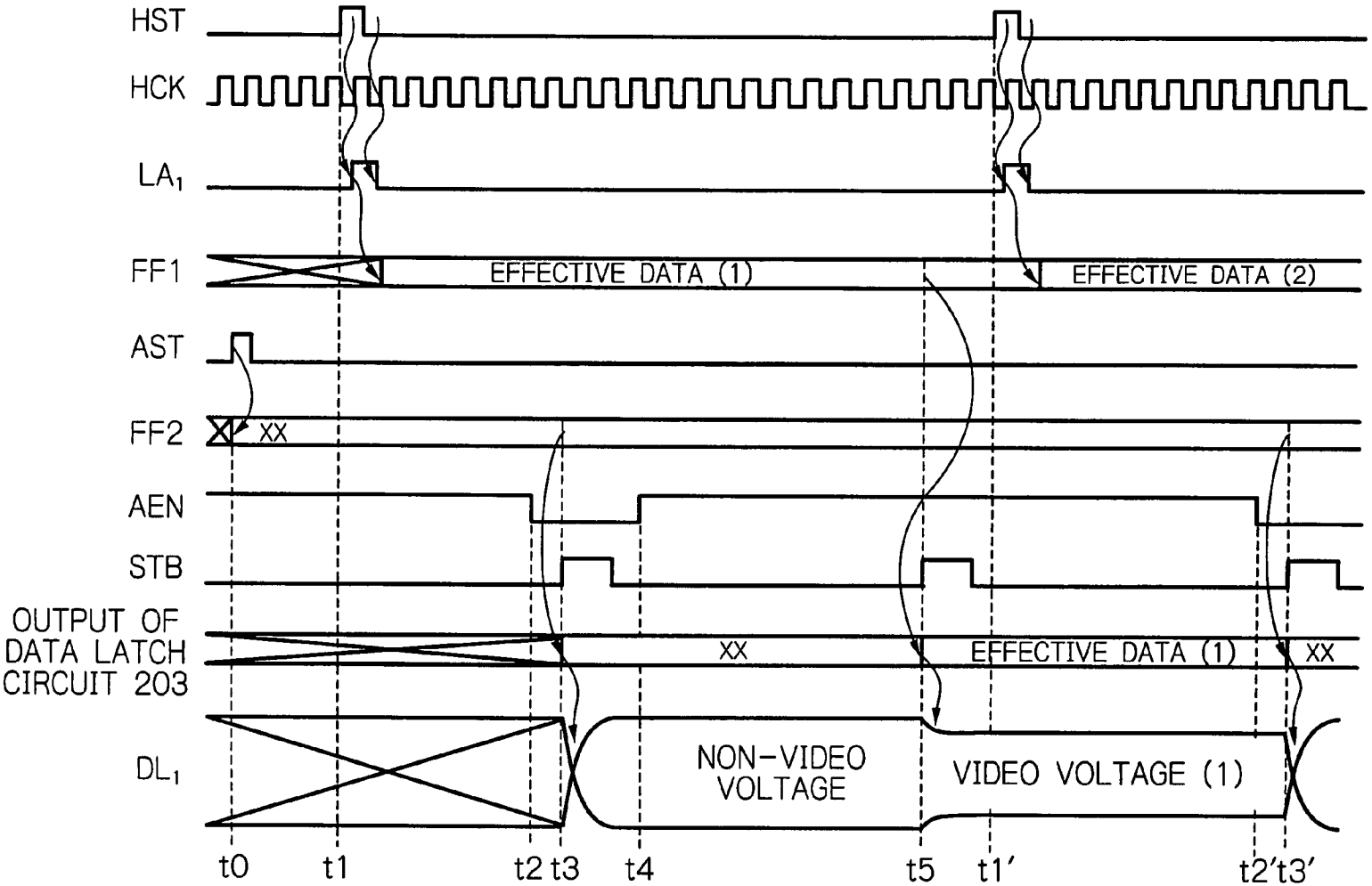

A second operation of the data line driver of FIG. 6 is explained next with reference to FIG. 9 which also shows an operation for one data line such as $DL_1$. In FIG. 9, the polarity of the definite non-video gradation voltage is the same as the gradation voltage of the next effective data. As a result, the definite non-video gradation voltage can serve as a precharging voltage for the gradation voltage of the next effective data, which would improve the response of the gradation voltage, particularly when the definite non-video gradation voltage represents a black voltage.

Figure 10:
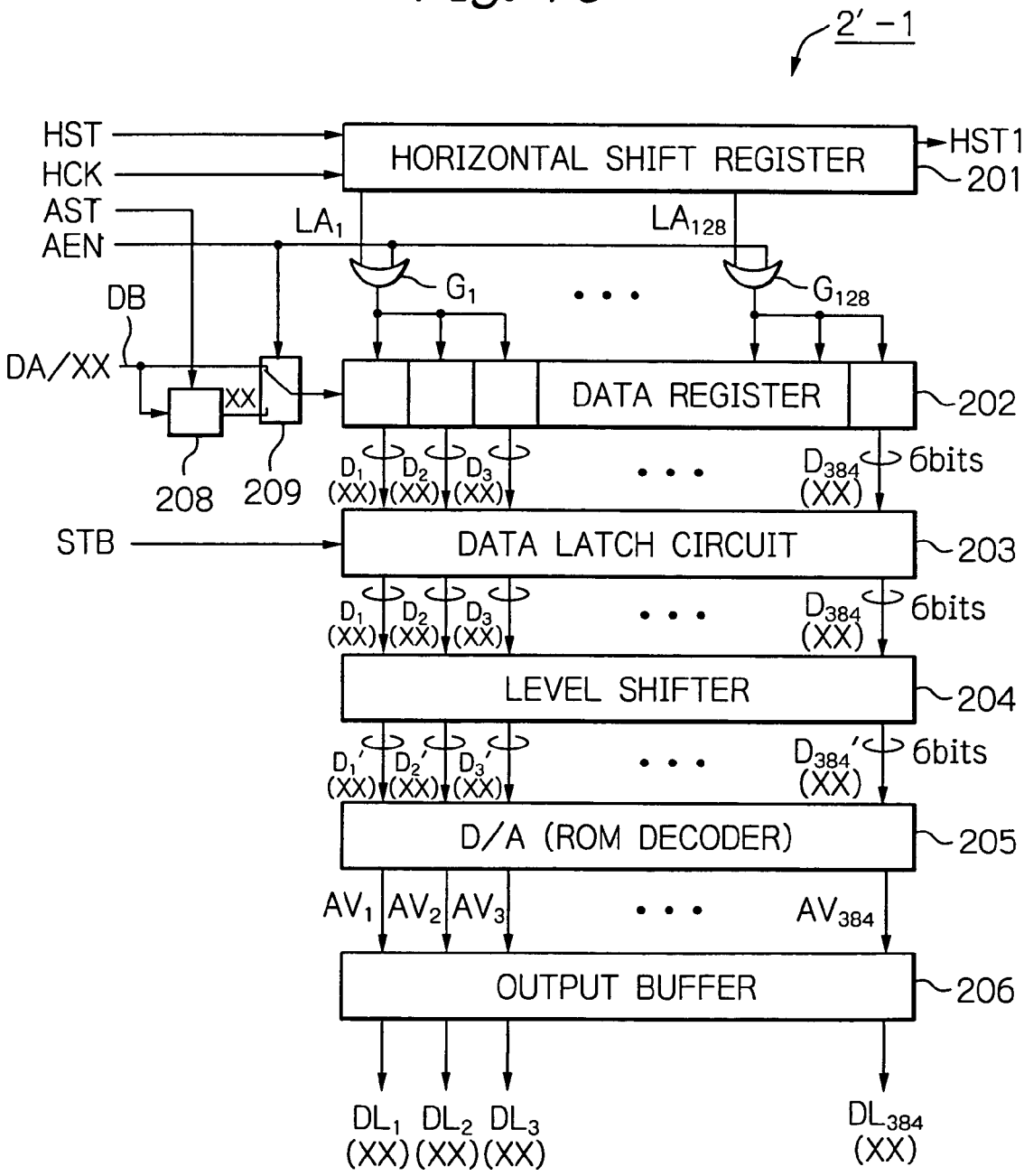
FIG. 10 is a detailed block circuit diagram of a second example of the data line driver of FIG. 5.

In FIG. 10, which is a detailed block circuit diagram of a second example of the data line driver 2'-1 of FIG. 5, a definite non-video gradation data latch circuit 208, a selector 209 and OR circuits $G_1, \ldots, G_{128}$ are provided instead of the switch circuit 207' of FIG. 6, and the data register 202' of FIG. 6 is replaced by the data register 202 of FIGS. 2 and 4.

The definite non-video gradation data latch circuit 208 latches a definite non-video data XX in synchronization with the definite non-video gradation data start signal AST. In this case, the controller 4' generates the video signal DA and the definite non-video gradation data XX time-divisionally, so that the definite non-video gradation data XX can be in synchronization with the definite non-video gradation data start signal AST.

The selector 209 selects one of the video signal DA and the definite non-video gradation data XX in synchronization with the definite non-video gradation data enable signal AEN. In more detail, when the definite non-video gradation data enable signal AEN is low, the selector 209 surely selects the output signal of the definite non-video gradation data latch circuit 208. Otherwise, the selector 209 passes the video signal DA plus the definite non-video gradation data XX therethrough.

Figures 11A, 11B:
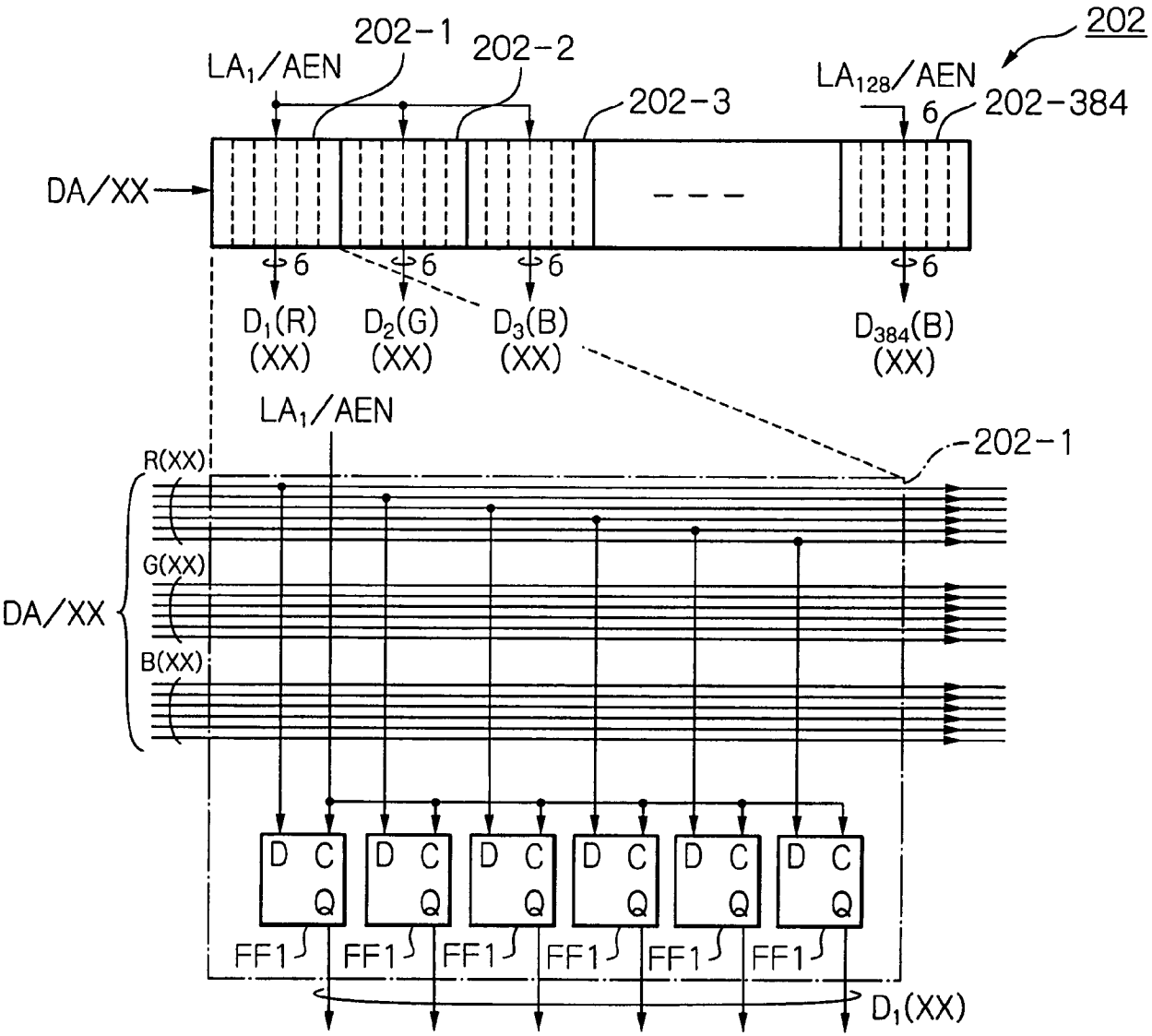
FIG. 11A is a detailed block circuit diagram of the data register of FIG. 10.
FIG. 11B is a detailed block circuit diagram of the 6-bit data register of FIG. 11A.

As mentioned above, the data register 202 is the same as that of FIGS. 2 and 4, as illustrated in FIGS. 11A and 11B. In this case, however, the definite non-video gradation data enable signal AEN also serves as another latch signal in addition to the latch signals $LA_1, \ldots, LA_{128}$. For example, the 6-bit data register 202-1 latches video signal DA ($D_1$) in synchronization with a rising edge of a latch signal $LA_1$, and also, the 6-bit data register 202-1 latches a definite non-video gradation data XX in synchronization with a falling edge of the definite non-video gradation data enable signal AEN.

A first operation of the data line driver of FIG. 10 is explained next with reference to FIG. 12 which shows an operation for one data line such as $DL_1$.

First, at time t0, a definite non-video gradation data start signal AST is generated so that the definite non-video gradation data XX is latched in the definite non-video gradation data latch circuit 208.

Next, at time t1, when a definite non-video gradation data enable signal AEN is changed from high to low, the definite non-video gradation data XX is latched in the flip-flops FF1 of the data register 202-1.

Next, at time t2, a strobe signal STB is generated. As a result, the definite non-video gradation data XX is latched in the data latch circuit 203 and is supplied via the level shifter 204 and the D/A converter 205 to the output buffer 206. Thus, a definite non-video gradation voltage corresponding to the definite non-video gradation data XX is applied to the data line $DL_1$. Then, at time t3, the definite non-video gradation data enable signal AEN is changed from low to high, so that the definite non-video gradation data XX remains in the 6-bit data register 202-1' of the data register 202' for the data line $DL_1$. Thus, the definite non-video gradation voltage at the data line $DL_1$ is retained.

Next, at time t4, a horizontal start signal HST is generated, so that the horizontal shift register 201 generates a latch signal $LA_1$ in synchronization with a horizontal clock signal HCK. As a result, a video data $D_1$ is latched as an effective data (1) in the 6-bit data register 202-1 (the flip-flops FF1) of the data register 202 and is supplied to the data latch circuit 203 for the data line $DL_1$.

Finally, at time t5, when a strobe signal STB is generated, the effective data (1) is latched in the data latch circuit 203 and is supplied via the level shifter 204 and the D/A converter 205 to the output buffer 206. As a result, a gradation voltage corresponding to the effective data (1) is applied to the data line $DL_1$.

Figure 12:
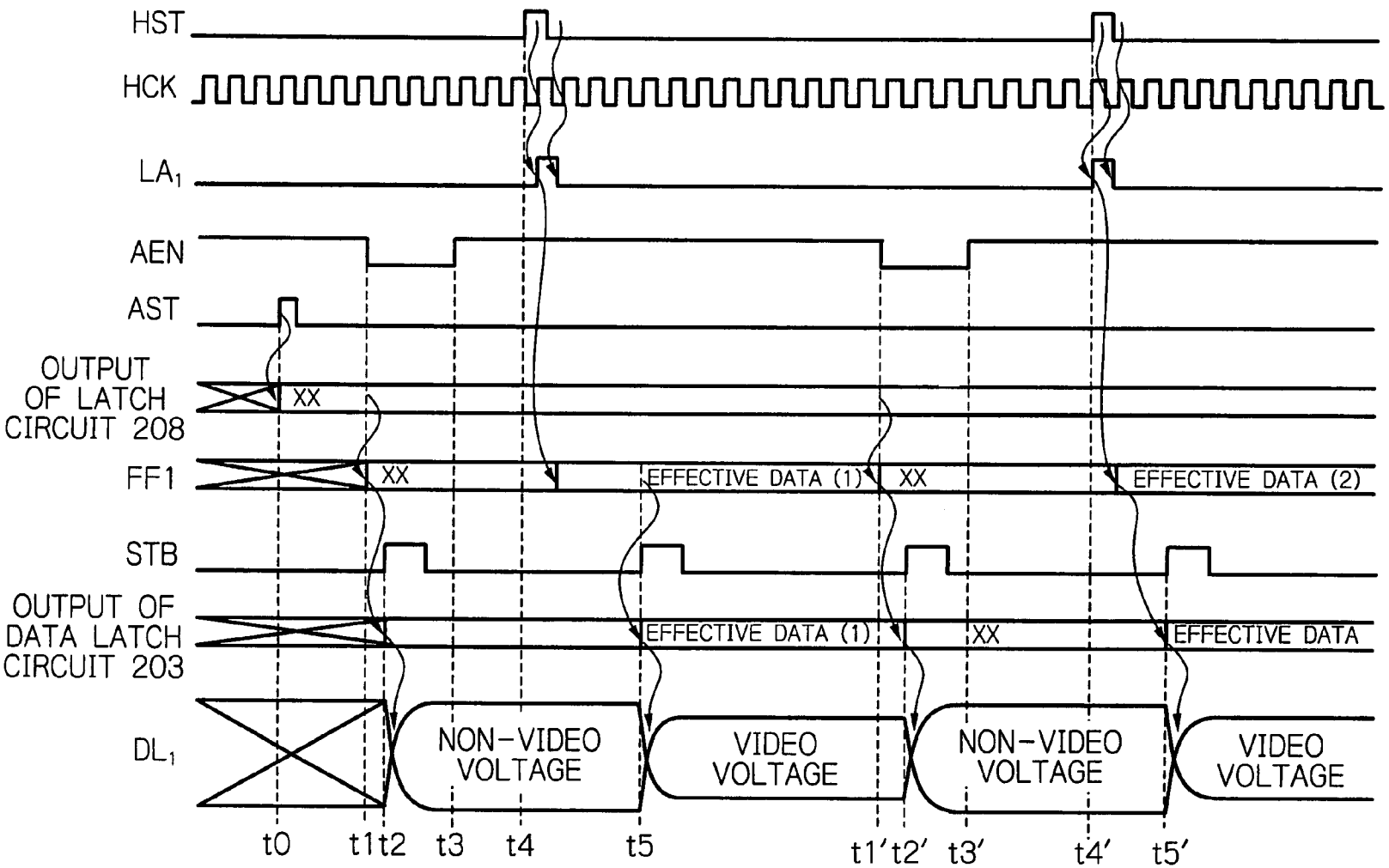
FIGS. 12 and 13 are timing diagrams for explaining the operation of the data register of FIG. 11A.

Thus, in FIG. 12, a gradation voltage and a definite non-video gradation voltage are alternately switched. In this case, the polarity of the gradation voltage is opposite to that of the definite non-video gradation voltage during one strobe signal period, thus removing the residual image effect of a moving image, particularly when the definite non-video gradation voltage represents a black voltage.

Figure 13:
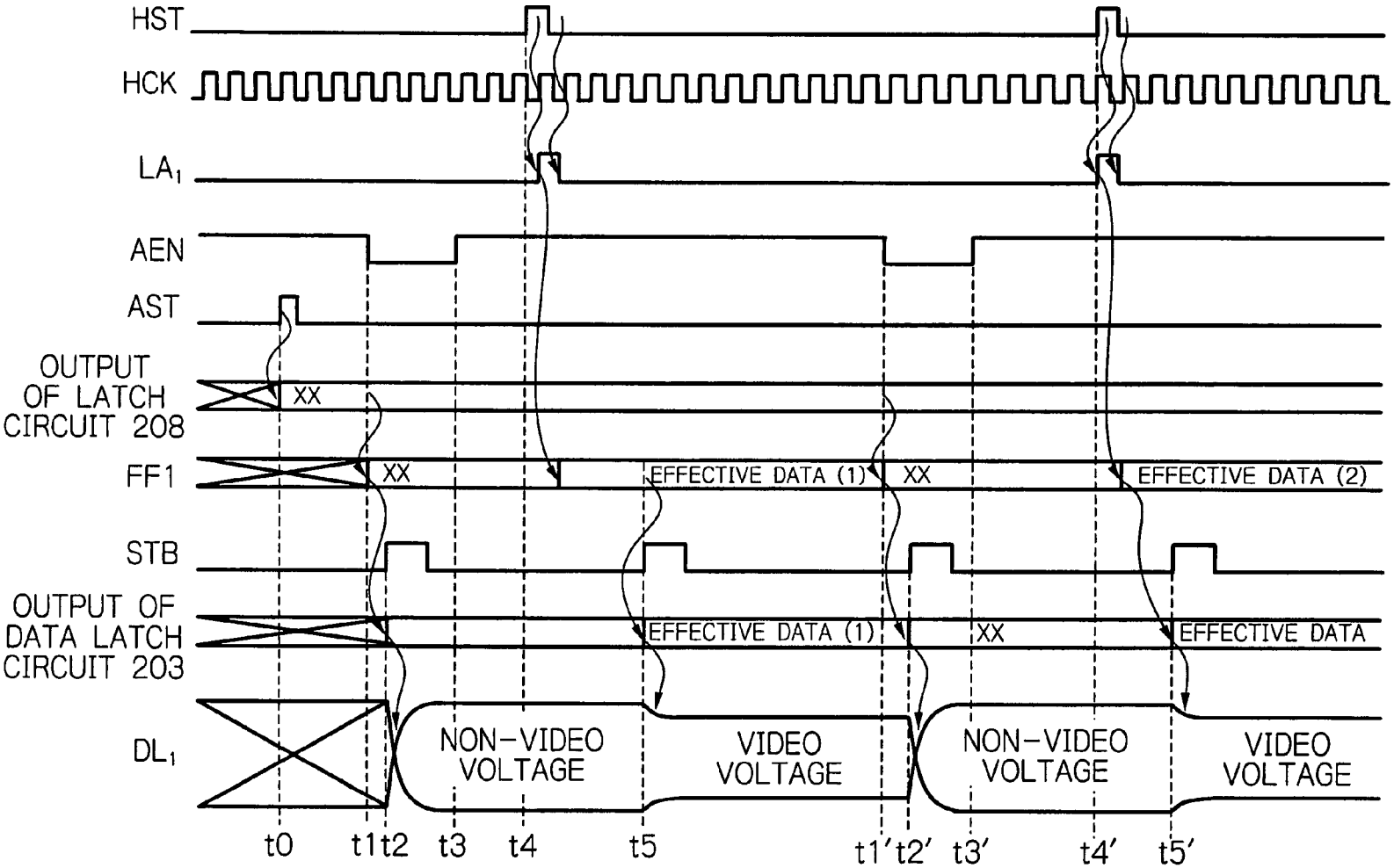

A second operation of the data line driver of FIG. 10 is explained next with reference to FIG. 13 which also shows an operation for one data line such as $DL_1$. In FIG. 13, the polarity of the definite non-video gradation voltage is the same as the gradation voltage of the next effective data. As a result, the definite non-video gradation voltage can serve as a precharging voltage for the gradation voltage of the next effective data, which would improve the response of the gradation voltage, particularly when the definite non-video gradation voltage represents a black voltage.

Note that the above-mentioned definite non-video gradation data can represent black data, white data or an intermediate data therebetween.

The present invention can also be applied to other plane type display apparatus such as a plasma display apparatus, or an organic or inorganic electroluminescence (EL) display apparatus.

As explained hereinabove, according to the present invention, a definite non-video gradation voltage can be easily generated and applied to data lines.

The invention claimed is:

1. A data line driver for driving data lines of a display apparatus, comprising:

a data register adapted to latch video data in synchronization with latch signals of a shift register and to latch definite non-video gradation data in synchronization with a definite non-video gradation start signal from an external controller via a data bus;

a data latch circuit adapted to latch the video data and the definite non-video gradation data at different timings to generate digital output signals of said data latch circuit into analog signals;

a digital/analog converter adapted to convert the digital output signals of said data latch circuit into analog signals;

an output buffer adapted to apply the analog signals of said digital/analog converter to said data lines; and a selector connected to said data bus and a definite non-video gradation data latch circuit, said selector adapted to select the video data or the definite non-video gradation data in accordance with a definite non-video gradation data enable signal.

2. A data line driver for driving data lines of a display apparatus, comprising:

a data register adapted to latch video data in synchronization with latch signals of a shift register and to latch definite non-video gradation data in synchronization with a definite non-video gradation start signal from an external controller via a data bus;

a data latch circuit adapted to latch the video data and the definite non-video gradation data at different timings to generate digital output signals of said data latch circuit into analog signals;

a digital/analog converter adapted to convert the digital output signals of said data latch circuit into analog signals;

an output buffer adapted to apply the analog signals of said digital/analog converter to said data lines;

a horizontal shift register adapted to shift a horizontal start signal in synchronization with a horizontal clock signal to sequentially generate said latch signals, said data register having a first data register section adapted to sequentially latch the video data in synchronization with said latch signals and a second data register section adapted to latch the definite non-video gradation data in synchronization with a definite non-video gradation start signal; and a switch circuit connected to said data register, said switch circuit adapted to select the video data of said first data register section or the definite non-video gradation data in accordance with a definite non-video gradation data enable signal, said digital/analog converter being connected via said switch circuit to said data register.

3. The data line driver as set forth in claim 1, further comprising:

a horizontal shift register adapted to shift a horizontal start signal in synchronization with a horizontal clock signal to sequentially generate said latch signals;

said definite non-video gradation data latch circuit adapted to latch the definite non-video gradation data via said data bus in synchronization with a definite non-video gradation data start signal, and said data register latching the video data or the definite non-video gradation data of said selector in synchronization with said latch signals and said definite non-video gradation data enable signal.

4. The apparatus as set forth in claim 1, wherein said definite non-video gradation data represents black data.

5. The apparatus as set forth in claim 1, wherein said definite non-video gradation data represents white data.

6. The apparatus as set forth in claim 1, wherein said definite non-video gradation data represents an intermediate data between black data and white data.

7. The data line driver as set forth in claim 1, wherein said display apparatus comprises a liquid crystal display apparatus.

8. A data line driver for driving data lines of a display apparatus, comprising:

a shift register adapted to shift a first start signal in synchronization with a clock signal to sequentially generate latch signals;

a data store circuit adapted to receive video data and non-video data via a data bus to latch the non-video data in response to a first control signal from an external controller;

a selector adapted to select the video data of said data bus or the non-video data of said data store circuit in response to a second control signal from the external controller;

a data register adapted to latch video data in synchronization with latch signals of said shift register and to latch non-video data in synchronization with said second control signal, so that the video data and the non-video data are latched at different timings;

a digital/analog converter adapted to convert latched data of said data register into an analog signal; and an output buffer adapted to apply the analog signal of said digital/analog converter to said data lines.

9. The data line driver as set forth in claim 8, wherein said non-video data comprises a definite gradation data.

* * * * *